US006168308B1

(12) United States Patent
Pittman et al.

(10) Patent No.: US 6,168,308 B1
(45) Date of Patent: Jan. 2, 2001

(54) MECHANICAL PROPORTIONER

(75) Inventors: David M. Pittman, Brooklyn Park; Kenneth E. Lehrke, Maple Grove; John F. Isais, Brooklyn Park; Vicky J. Peterson, Brooklyn Center; Adam R. Friedrich, St. Paul, all of MN (US)

(73) Assignee: Graco Minnesota Inc., Minneapolis, MN (US)

( * ) Notice: Under 35 U.S.C. 154(b), the term of this patent shall be extended for 0 days.

(21) Appl. No.: 09/250,770

(22) Filed: Feb. 15, 1999

Related U.S. Application Data

(60) Provisional application No. 60/075,191, filed on Feb. 19, 1998.

(51) Int. Cl.[7] ..... B01F 15/02

(52) U.S. Cl. ..... 366/162.3; 366/177.1; 366/182.2; 222/137

(58) Field of Search ..... 366/160.4, 162.3, 366/176.3, 177.1, 181.8, 182.2, 190, 267, 268, 178.1; 222/134, 135, 136, 137; 417/102, 103

(56) References Cited

U.S. PATENT DOCUMENTS 3,814,289 * 6/1974 Robbins ..... 222/134
3,981,487 * 9/1976 Papoff et al. ..... 366/181.8
4,538,920 * 9/1985 Drake ..... 366/181.8
5,114,241 * 5/1992 Morrison ..... 366/162.3
5,234,268 * 8/1993 Homan ..... 366/181.8
5,524,983 * 6/1996 Dittgen et al. ..... 366/160.4
5,540,498 * 7/1996 Chu ..... 366/160.4

* cited by examiner

*Primary Examiner*—Tony G. Soohoo
(74) *Attorney, Agent, or Firm*—Douglas B. Farrow

(57) ABSTRACT

A mechanical proportioner is provided with two pump lowers which are connected together by a yolk underneath an air-operated reciprocating piston pump. The pumps are staggered axially so as to enable overlapping of certain portions thereof thereby enabling the center-to-center distance to be minimized. The mix manifold is constructed in a concentric fashion such that mixed material does not come into contact with the mix manifold until it enters the static mixer at the exit of the manifold which is an easily disposable and replaceable part. The purge solvent valves on the mix manifold are each provided with an extension of their respective handles. If either purge valve is in its open position, a separate interlock handle operating the A and B side valves at the manifold inlet is prevented from opening. Similarly, if the interlock handle operating the A and B side valves is open, the purge valves cannot be opened.

2 Claims, 5 Drawing Sheets

MECHANICAL PROPORTIONER

RELATED APPLICATIONS

This application is a continuation-in-part of U.S. application Ser. No. 60/075,191, filed Feb. 19, 1998.

BACKGROUND OF THE INVENTION

Mechanical proportioners for mixing plural component materials are of course in general well known and have been used successfully for a number of years. One problem that has become apparent however is that materials in recent years have become more and more viscous and are requiring higher and higher pressures for mixing and application. Because of these higher pressures required, much higher forces are required and this has presented a number of mechanical problems which require solution.

Such proportioners can also be prone at times to mixed materials setting up within the mix manifold therefore requiring tedious disassembly and cleaning or sometimes in fact even replacement of parts because of the setup mixed materials therein. Also due to the substantial cost of these materials, it is important that the operator be assured that the machine is operating properly in the proper configuration when desired.

SUMMARY OF THE INVENTION

It is therefore an object of this invention to provide a mechanical proportioner which is capable of mixing materials at high pressures utilizing the elevated forces required to do so and which is mechanically sound and reasonably easily disassembled for servicing and the like.

It is yet a further object of this invention to provide a mix manifold which minimizes exposure of the manifold surfaces to mixed material.

It is yet a further object of this invention to provide an interlock scheme for the valves and mix manifold so as to ensure that all valves are properly positioned for operation or purging.

Two pump lowers are connected together by a yolk underneath an air-operated reciprocating piston pump (other types of reciprocating pumps may of course be utilized) such as Graco's Premier pump. The air motor shaft enters the yolk in the center and the two pump lower shafts are located equidistant from the center of either side thereof. It is important to be able to minimize the distance between the two pump rods and toward that end, the pumps are staggered axially so as to enable overlapping of certain portions thereof thereby enabling the center-to-center distance to be minimized.

A small interference fit of the pump shafts and the yolk at the bottom end thereof in conjunction with substantial torque ensures that the center distance is absolutely balanced on either side of the air motor shaft.

The mix manifold is constructed in a concentric fashion such that mixed material does not come into contact with the mix manifold until it enters the static mixer at the exit of the manifold which is an easily disposable and replaceable part. While the two components may be in contact with one another, that point of contact is isolated from the interior surface of the mix manifold.

The purge solvent valves on the mix manifold are each provided with an extension of their respective handles. If either purge valve is in its open position, a separate interlock handle operating the A and B side valves at the manifold inlet is prevented from opening. Similarly, if the interlock handle operating the A and B side valves is open, the purge valves cannot be opened.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
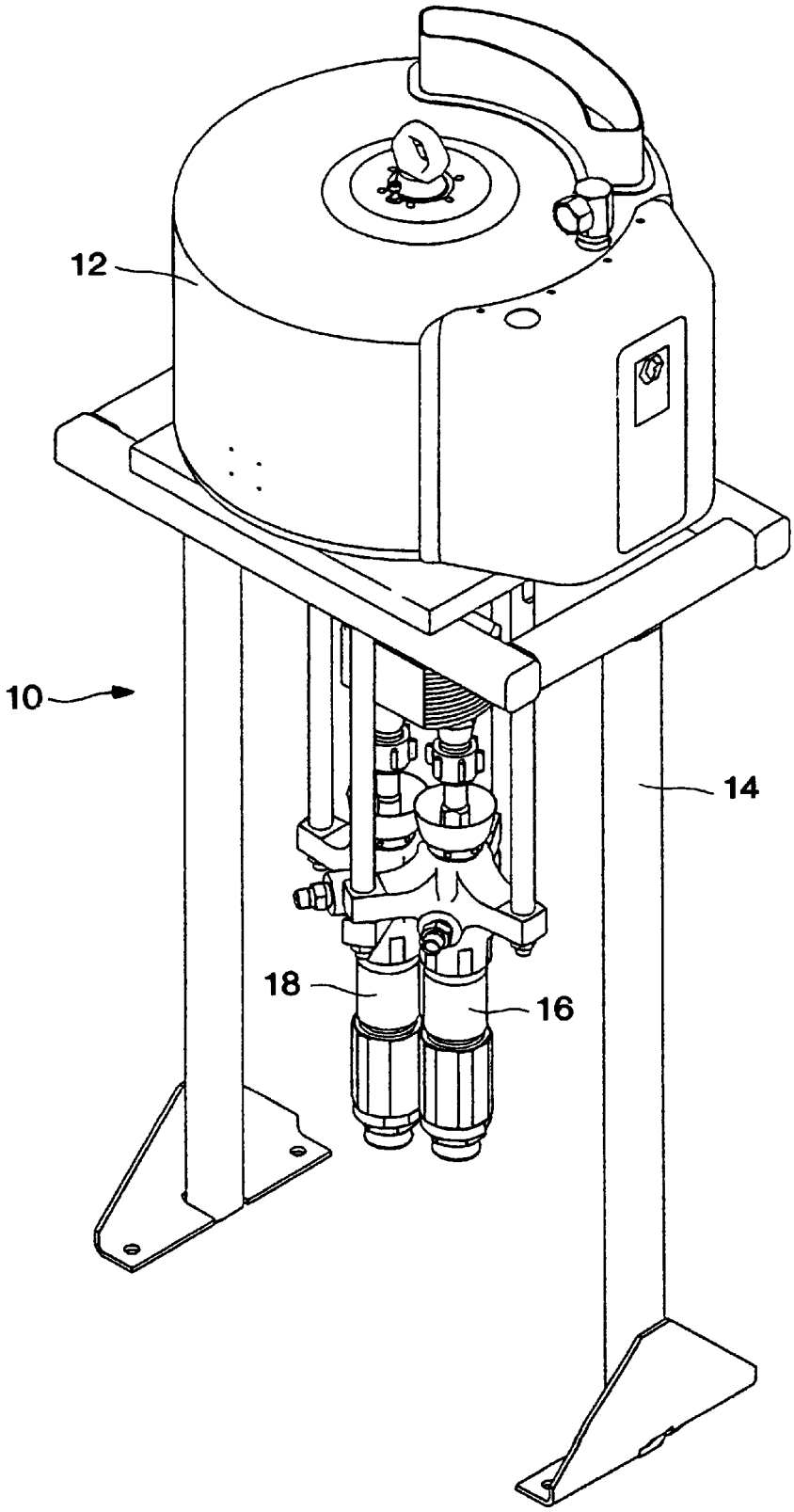
FIG. 1 is a perspective view of the proportioner of the instant invention showing the overlapping pump lowers.
Figure 2:
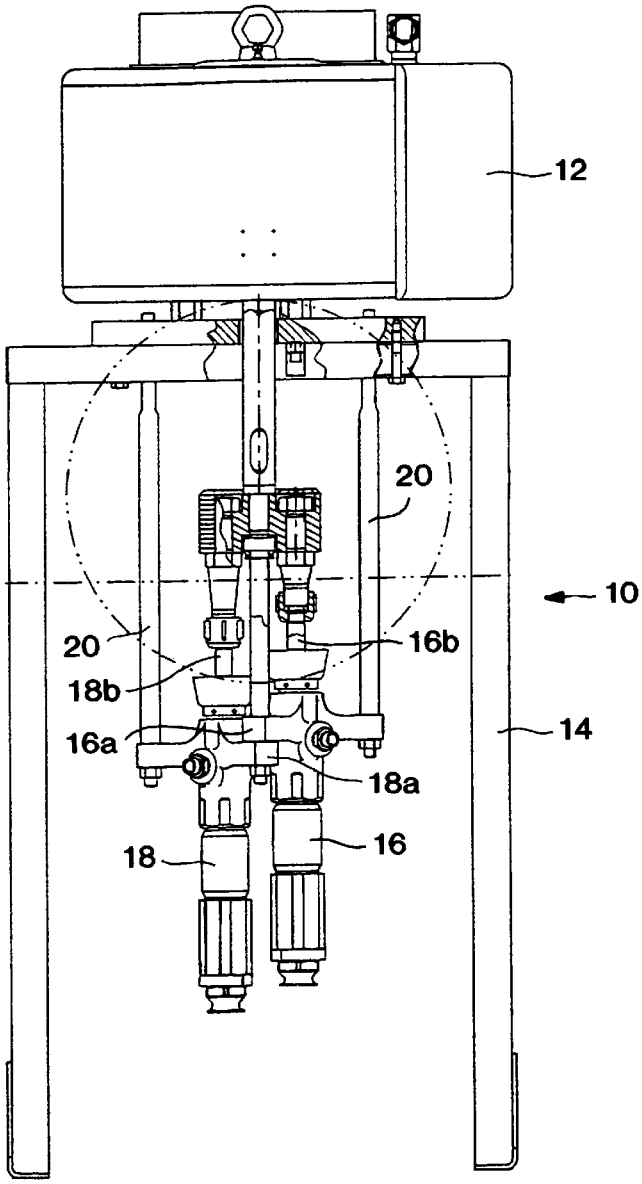
FIG. 2 is a side plan view showing the proportioner having the overlapping lowers.
Figure 3:
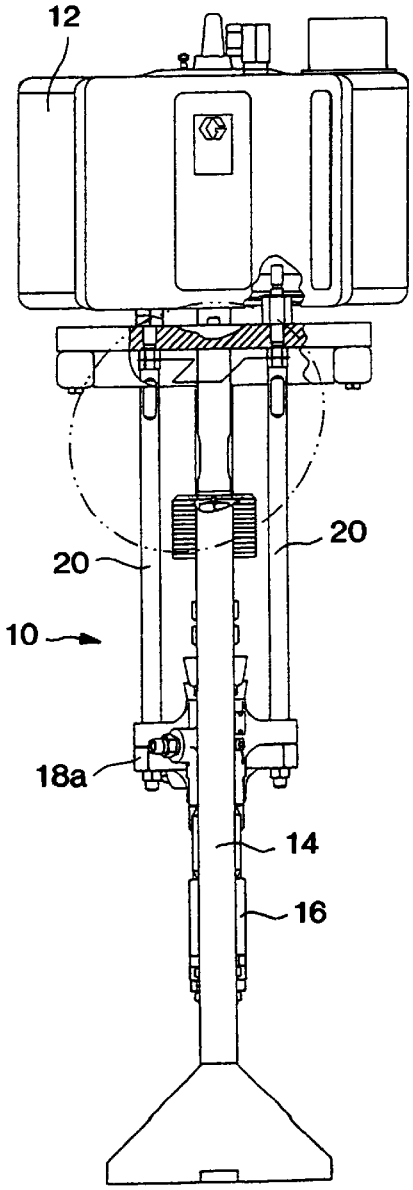
FIG. 3 is an end plan view of the proportioner of the instant invention showing the overlapped lowers.

The instant invention generally designated 10 is comprised of a reciprocating air motor 12 mounted to a frame 14. Depending from frame 14 and pump 12 are first and second pump lowers 16 and 18 respectively as illustrated in FIG. 1 through 3. As can be seem most clearly in FIG. 2, pump lowers 16 and 18 are axially staggered, that is one is mounted slightly above the other so that the mounting ears 16*a* and 18*a* respectively may be overlapped to decrease the center-to-center distance between the two lowers. This overlap is also used in conjunction with mounting rods 20 for location.

Figure 4:
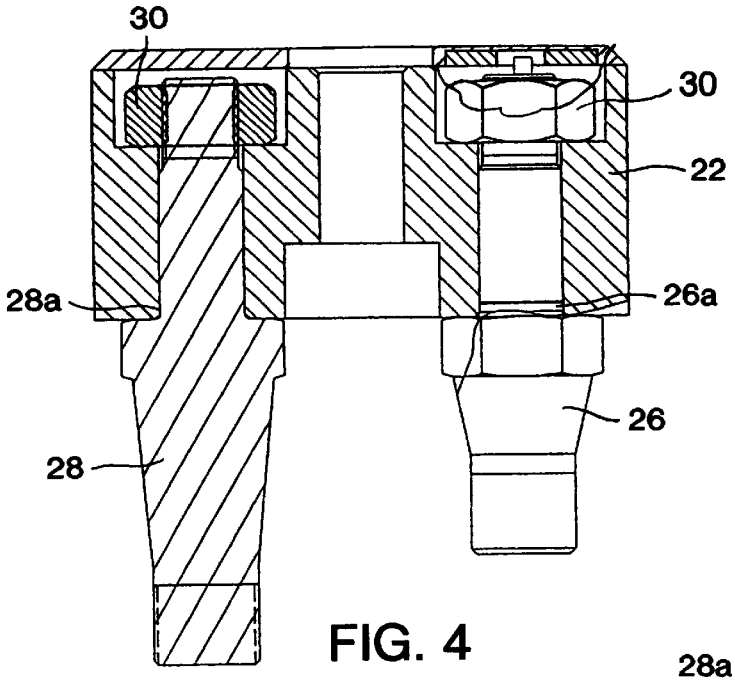
FIG. 4 shows a cross-section of the yolk of the instant invention.
Figure 5:
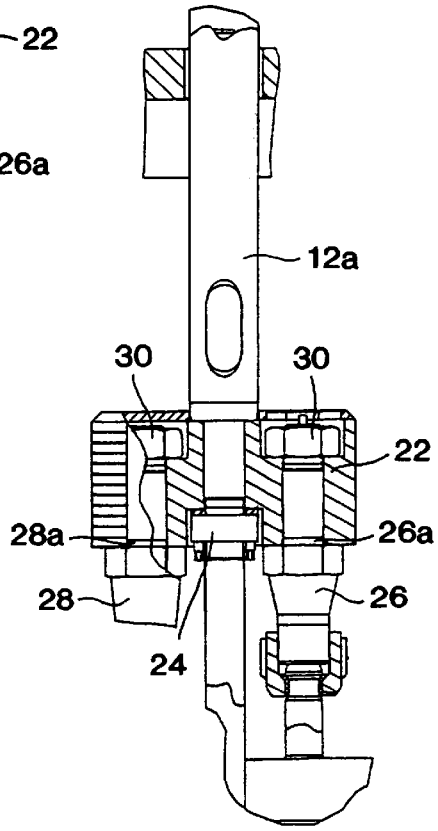
FIG. 5 shows another view of the yolk assembly of the instant invention.

Air motor shaft 12*a* extends downwardly therefrom into yolk 22 where it is affixed by bolt assembly 24. As can be seen in FIG. 4 and 5, intermediate coupler members 26 and 28 are attached to pump lower rods 16*b* and 18*b* respectively. A small portion 26*a* and 28*a* of couplers 26 and 28 have a small interference fit (on the order of 0.0015 inches) for about 0.10 inches in the axial direction with yolk 22 which in conjunction with a 550 ft-lb torque pre-load on nuts 30 serves to absolutely locate the couplers 26 and 28 in yolk 22 at a substantially identical distance from pump rod 12*a*.

Figure 6:
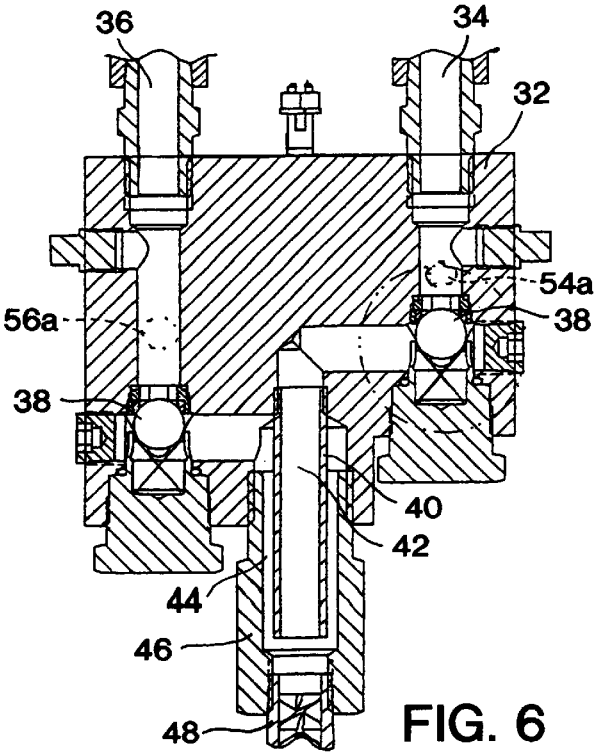
FIG. 6 shows a cross-sectional view of the mix manifold.

The mix manifold 32 shown in FIG. 6 is provided with "A" (or resin) or side inlet passage 36 and a "B" or catalyst side inlet passage 34. Each passage is provided with a check valve assembly 38 and an inlet 34 on the "B" side leads to an inner concentric tube 40 having a passage 42 therein. "A" side passage 36 leads to an outer concentric passage 44 formed in an outlet fitting 46 which has connected at the exit thereof a standard static mixer 48.

As can be seen, the two materials are only exposed to one another for a very short distance within manifold assembly 32 and in fact the interface between the two materials is isolated from the surface of either tube 40 or fitting 46 by the outermost of the concentric materials.

Figure 7:
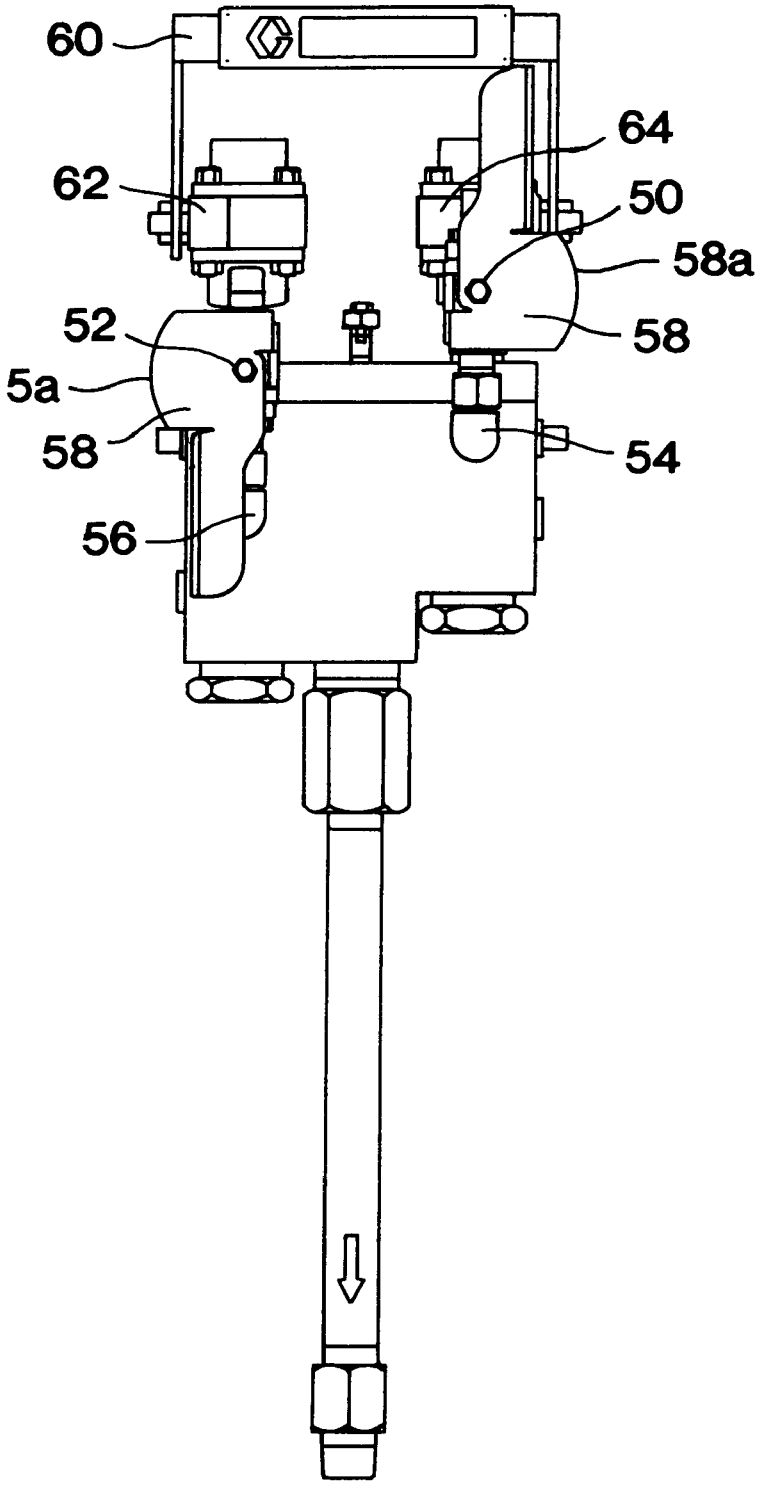
FIG. 7 shows the side plan view of the mix manifold assembly including the solvent flush valves and interlock assembly in the flush position.
Figure 8:
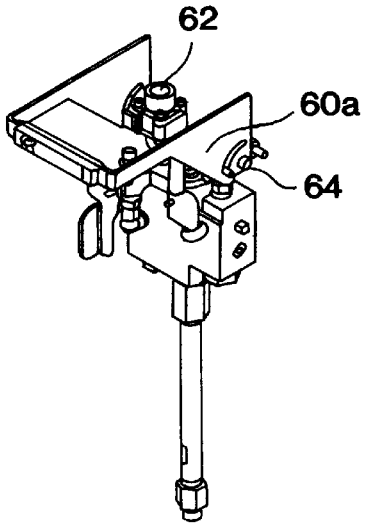
FIG. 8 shows a perspective view of the manifold assembly in the flush position.
Figure 9:
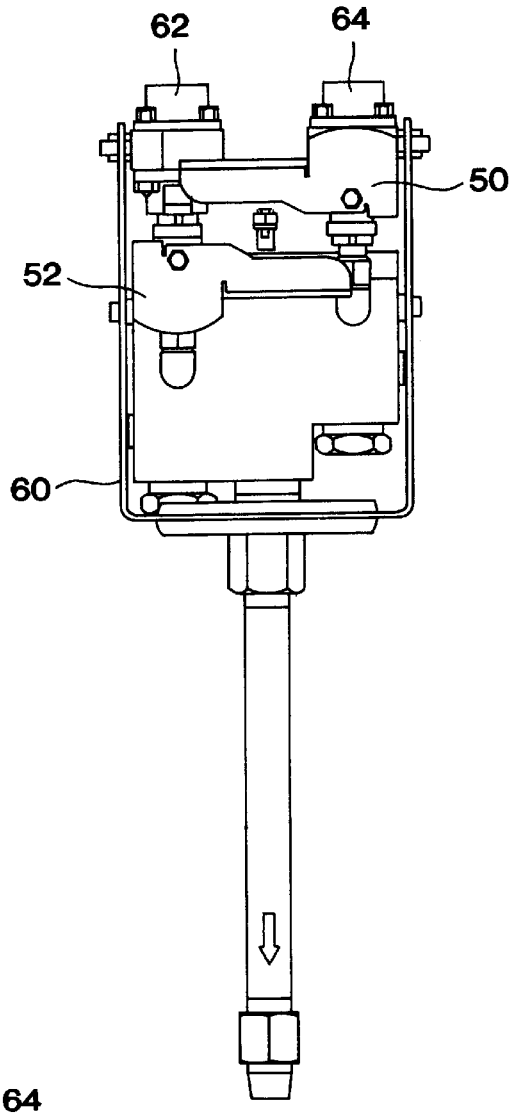
FIG. 9 shows a view similar to FIG. 7 in the operating position.
Figure 10:
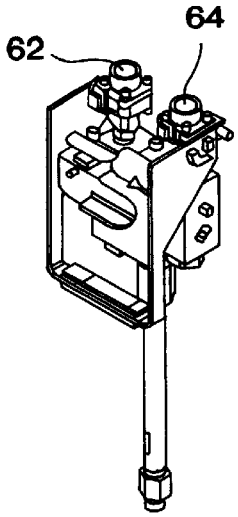
FIG. 10 shows a view similar to FIG. 8 in the operating position.

First and second material manifold inlet valves 62 and 64 (at inlets 36 and 34 respectively) are operated by interlock handle 60. First and second solvent flush valves 50 and 52 enter manifold 32 via fittings 54 and 56, the entry point of which is shown in phantom in FIG. 6 by dotted circles 54*a* and 56*a* respectively. The solvent flush valves are provided with handles 58 each of which has an extending portion 58*a*. When the solvent valves are in the open position shown in FIG. 7, interlock handle 60 also shown in FIG. 8 must be in its raised position closing inlet valves 62 and 64 and the wings 60*a* thereof are prevented from lowering because of interference with extensions 58*a* on the solvent flush valves. Only when the solvent flush valves 50 and 52 are moved to the closed position shown in FIG. 9 and 10 is the interference with wings 60*a* on interlock handle 60 removed thereby allowing it to move to the operating position open shown in FIG. 9 and 10. This readily visually apparent interlocking mechanism helps ensure that the solvent valves will be closed when the material valves are open and vice versa.

It is contemplated that various changes and modifications may be made to the proportioner without departing from the spirit and scope of the invention as defined by the following claims.

What is claimed is:

1. A mechanical proportioner for mixing and dispensing plural component materials, said proportioner comprising:

a reciprocating power source;

first and second reciprocating pump lowers, each said pump lower having an axis of reciprocation, said axes being parallel, said pump lowers being axially staggered so as to allow a minimum distance between said axes each of said lowers having an outlet, said outlets being connected to mix and proportion plural component materials; and a coupling connecting said pump lowers and said power source, said power source being attached to said coupling between said pump lower axes, said coupling having first and second opposite sides, said reciprocating power source being connected to said coupling on said first side and said pump lowers being connected to said coupling on said second side.

2. The mechanical proportioner of claim 1 wherein each of said pump lowers further comprises a coupler member, each said coupler member being interference fit in said coupler to assure an exact matching offset for each said lower relative to said power source.

* * * * *